US009873990B2

(12) United States Patent
Frelich et al.

(10) Patent No.: US 9,873,990 B2
(45) Date of Patent: Jan. 23, 2018

(54) PAVING MACHINE HAVING PRODUCTION MONITORING SYSTEM

(71) Applicant: Caterpillar Paving Products Inc., Brooklyn Park, MN (US)

(72) Inventors: Toby Andrew Frelich, Saint Michael, MN (US); Ricky Leon Mings, Oak Grove, MN (US); Dana Wade Miller, Coon Rapids, MN (US); Luke Edward Graham, Maple Grove, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/813,361

(22) Filed: Jul. 30, 2015

(65) Prior Publication Data

US 2017/0030030 A1 Feb. 2, 2017

(51) Int. Cl.

| | |
|---|---|
| ***E01C 7/00*** | (2006.01) |
| ***E01C 19/45*** | (2006.01) |
| ***E01C 7/35*** | (2006.01) |
| ***E01C 19/00*** | (2006.01) |
| ***E01C 19/02*** | (2006.01) |
| ***E01C 19/46*** | (2006.01) |
| ***E01C 19/48*** | (2006.01) |
| ***E01C 23/07*** | (2006.01) |

(52) U.S. Cl.

CPC ..... *E01C 19/45* (2013.01); *E01C 7/00* (2013.01); *E01C 7/35* (2013.01); *E01C 19/002* (2013.01); *E01C 19/02* (2013.01); *E01C 19/46* (2013.01); *E01C 19/48* (2013.01); *E01C 19/4866* (2013.01); *E01C 23/07* (2013.01)

(58) Field of Classification Search

CPC . E01C 7/00; E01C 7/35; E01C 19/002; E01C 19/02; E01C 19/45; E01C 19/46; E01C 19/4866; E01C 23/07

USPC ..... 404/84.05–84.5, 118, 101, 105, 107

See application file for complete search history.

(56) References Cited

U.S. PATENT DOCUMENTS

| | | | | |
|---|---|---|---|---|
| 3,678,817 A * | 7/1972 | Martenson | ..... | E01C 19/48 404/108 |
| 5,393,167 A * | 2/1995 | Fujita | ..... | E01C 19/006 404/118 |
| 7,121,762 B2 * | 10/2006 | Quenzi | ..... | E01C 19/006 404/114 |
| 7,172,363 B2 | 2/2007 | Olson et al. | | |

(Continued)

FOREIGN PATENT DOCUMENTS

| | | |
|---|---|---|
| CN | 103866673 A | 6/2014 |
| DE | 102 34 217 A1 | 2/2004 |

*Primary Examiner* — Raymond W Addie

(74) *Attorney, Agent, or Firm* — Finnegan, Henderson, Farabow, Garrett & Dunner, LLP

(57) ABSTRACT

A monitoring system for a paving machine having a screed may include an input device configured to receive a first input from an operator of the paving machine, the first input being indicative of a height of the screed above a work surface, and a controller electronically connected to the input device. The controller may be configured to determine an amount of a material deposited by the paving machine based on the first input, receive a signal indicative of an amount of a material delivered to the paving machine, and determine a correction factor based on the amount of the material deposited by the paving machine and the amount of the material delivered to the paving machine.

20 Claims, 4 Drawing Sheets

(56) References Cited

U.S. PATENT DOCUMENTS

| | | | | |
|---|---|---|---|---|
| 7,484,911 | B2 * | 2/2009 | Frelich | E01C 19/48 222/71 |
| 7,654,769 | B2 * | 2/2010 | Herrmann | E01C 19/008 299/1.9 |
| 8,282,312 | B2 | 10/2012 | Braddy et al. | |
| 8,371,769 | B2 * | 2/2013 | Worsley | E01C 23/07 404/118 |
| 8,696,237 | B2 * | 4/2014 | Hanfland | G01B 21/08 404/118 |
| 8,702,344 | B2 | 4/2014 | Hanfland | |
| 8,930,092 | B2 | 1/2015 | Minich | |
| 8,979,423 | B2 | 3/2015 | Smieja | |
| 9,260,827 | B2 * | 2/2016 | Bertz | E01C 19/48 |
| 2006/0045620 | A1 * | 3/2006 | Olson | E01C 19/48 404/84.1 |
| 2010/0150650 | A1 * | 6/2010 | Buschmann | E01C 19/48 404/82 |
| 2012/0321386 | A1 * | 12/2012 | Hanfland | G01B 21/08 404/118 |

* cited by examiner

PAVING MACHINE HAVING PRODUCTION MONITORING SYSTEM

TECHNICAL FIELD

The present disclosure relates generally to a paving machine and, more particularly, to a paving machine having a production monitoring system.

BACKGROUND

Paving machines are used to deposit layers of asphalt onto a roadway or parking lot bed. A paving machine generally includes a hopper that receives heated asphalt, a screed, and a conveying system that moves the heated asphalt from the hopper onto the bed in front of the screed. During operation, the screed is pushed or pulled over the asphalt to level and shape the asphalt into a layer of paving material having a desired thickness and width. The screed is typically connected to the paving machine via a hinged connection and is allowed to "float" on top of the asphalt and use its weight to level and shape the layer. In some applications, the paving machine is connected to and towed by a dump truck supplying the asphalt to the hopper. In other applications, the paving machine includes a tractor that self-powers the paving machine.

The thickness of the asphalt layer deposited by the paving machine is a function of multiple factors, including the speed of the paving machine, the feed rate of asphalt from the hopper, and the elevation of the point at which the screed is connected to the paving machine. During a paving operation, it can be difficult to determine whether the proper amount of asphalt is being applied to the bed and whether any of these factors should be adjusted until at least a significant portion of the bed has been covered with asphalt. As a result, portions of the bed may receive too much asphalt and incur a greater cost than anticipated, or receive too little asphalt and incur a penalty for failing to meet the customer's specifications. Similar situations may arise throughout the paving operation as the thickness and width of the layer is varied by the paving crew in accordance with the customer's specifications.

One attempt to monitor the amount of material deposited by a paving machine is disclosed in U.S. Pat. No. 8,930,092 B2 of Minich that issued on Jan. 6, 2015 ("the '092 patent"). Specifically, the '092 patent discloses an asphalt paver having a hopper for storing asphalt, a tractor drive system for transporting the hopper, and a variable-width screed attached to the tractor drive system. A conveyor transports asphalt from the hopper to the front of the screed via a tunnel, where an auger disperses the asphalt along the width of the screed. The width of the screed is sensed by width sensors attached to left and right sides of the screed. Material height sensors disposed within the tunnel measure the height of the material as it travels from the hopper to the screed, and motion detection devices measure the linear speed of the conveyor. Using a calibration curve, a computer system determines an incremental weight of asphalt being laid down by the paver based on the screed width, material height, and conveyor speed. Using the paver speed (as determined by a speed sensor), the computer system determines an instantaneous amount of paving material or "yield" being applied during the paving process as well as a total yield over period of paving time. The total yield is compared to an actual or "ticket" amount of asphalt delivered by a truck to determine whether all of the delivered asphalt was consumed by the paver.

Although the paver of the '092 patent may allow paver yield to me monitored, it may not be optimum. In particular, the paver of the '092 patent may not accurately determine how much asphalt has actually been applied since the height sensors used to determine the instantaneous yield may only reflect an amount of material on the conveyor, whereas the actual yield deposited may vary as paver and screed settings are adjusted during the paving process. Further, the calibration curve used to determine the weight of material may not be applicable to various types of paving materials having different properties, which may lead to inaccurate weight determinations.

The disclosed production monitoring system are directed to overcoming one or more of the problems set forth above and/or other problems of the prior art.

SUMMARY

In one aspect, the present disclosure is directed to a monitoring system for a paving machine having a screed. The monitoring system may include an input device configured to receive a first input from an operator of the paving machine, the first input being indicative of a height of the screed above a work surface, and a controller electronically connected to the input device. The controller may be configured to determine an amount of a material deposited by the paving machine based on the first input, receive a signal indicative of an amount of a material delivered to the paving machine, and determine a correction factor based on the amount of the material deposited by the paving machine and the amount of the material delivered to the paving machine.

In another aspect, the present disclosure is directed to a method of monitoring a paving machine having a screed. The method may include receiving a first input from the operator of the paving machine, the first input being indicative of a height of the screed above a work surface. The method may further include determining an amount of a material deposited by the paving machine based on the first input, receiving a signal indicative of an amount of a material delivered to the paving machine, and determining a correction factor based on the amount of the material deposited by the paving machine and the amount of the material delivered to the paving machine.

In yet another aspect, the present disclosure is directed to a paving machine. The paving machine may include a machine frame, a plurality of traction devices configured to support the machine frame, an engine mounted to the machine frame and configured to drive the plurality of traction devices, a hopper mounted at a first end of the machine frame, a conveying system configured to transport material from the hopper to a second end of the machine frame, and a screed mounted at the second end of the machine frame. The paving machine may further include an input device configured to receive an input from an operator of the paving machine, the input being indicative of a height of the screed above a work surface, and a controller electronically connected to the input device. The controller may be configured to determine an amount of a material deposited by the paving machine based on the first input, receive a signal indicative of an amount of a material delivered to the paving machine, determine a correction factor based on the amount of the material deposited by the paving machine and the amount of the material delivered to the paving machine, and determine a subsequent amount of material deposited by the paving machine based on the correction factor.

DETAILED DESCRIPTION

Figure 1:
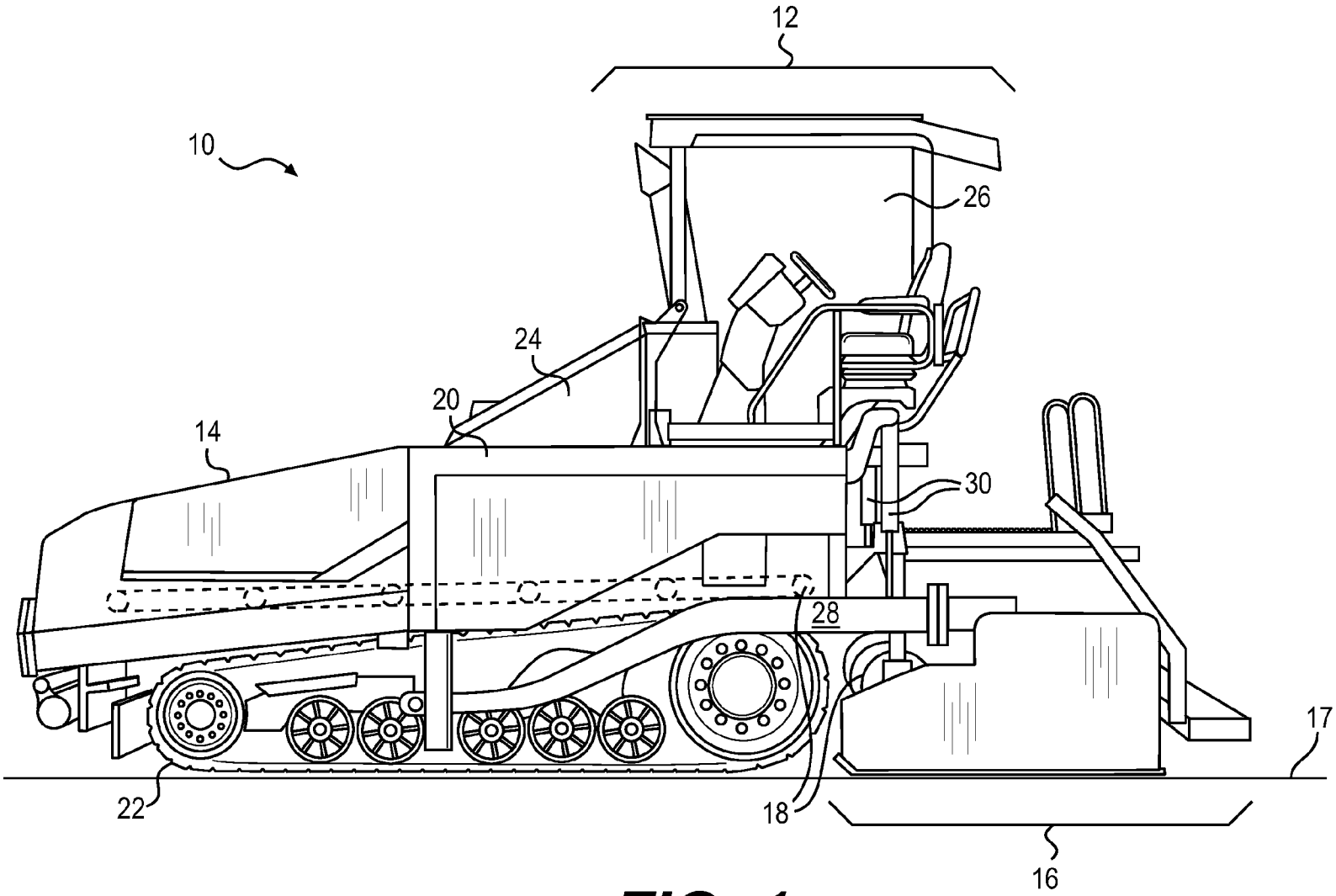
FIG. 1 is a side-view illustration of an exemplary disclosed paving machine.

FIG. 1 illustrates an exemplary paving machine 10 having a tractor portion 12 carrying a front-mounted hopper 14 and towing a screed assembly 16. A conveying system 18 having belts, chains, and/or augers may be situated to transport paving material (e.g., a hot asphalt mixture) from hopper 14 to screed assembly 16. Screed assembly 16 may then level and shape the material into a layer having a desired thickness and width on top of a work surface 17. In the disclosed example, paving machine 10 is self-powered by way of tractor portion 12. It is contemplated, however, that tractor portion 12 may alternatively be omitted, and hopper 14 and/or screed assembly 16 towed by another machine (e.g., a dump truck), if desired.

Tractor portion 12 may include, among other things, a machine frame 20, a plurality of traction devices 22 (e.g., tracks or wheels—only one shown in FIG. 1) configured to support machine frame 20, a power source (e.g., an engine) 24 configured to drive traction devices 22, and an operator station 26 configured to provide operator control over paving machine 10. Machine frame 20 may support hopper 14, and transmit tractive forces to screed assembly 16 (e.g., by way of tow arms 28—only one shown in FIG. 1). One or more actuators 30 may be connected between machine frame 20 and tow arms 28, and controlled (e.g., for example via operator station 26) to raise, lower, shift, and/or tilt screed assembly 16 relative to machine frame 20. It is also contemplated that screed assembly 16 may generally be free floating, if desired, and only raised or lowered for roading or paving operations, respectively.

Figure 2:
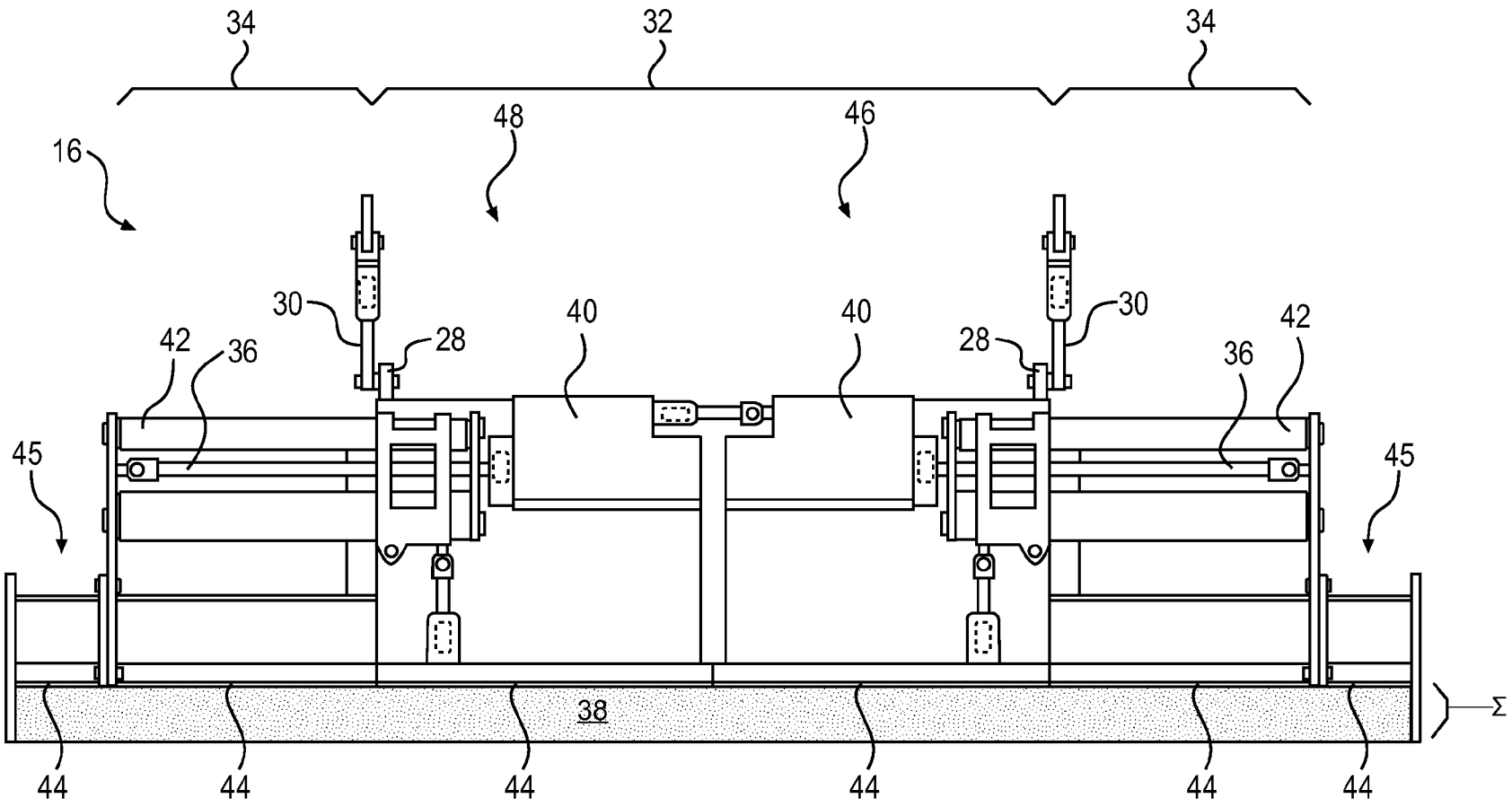
FIGS. 2 and 3 are end-views of a screed assembly that may be used in conjunction with the paving machine of FIG. 1.

As shown in FIG. 2, screed assembly 16 may be a compilation of components that cooperate to shape, level, and compact the asphalt mixture transferred from hopper 14 onto work surface 17 in front of screed assembly 16 by conveying system 18. These components may include a main screed 32 and, in some embodiments, one or more auxiliary screeds 34 that are extendably mounted at opposing ends of main screed 32. Auxiliary screeds 34 may be moved in-and-out relative to main screed 32 by way of one or more hydraulic actuators 36, so as to adjust a width of the resulting asphalt layer 38 laid down by screed assembly 16. Auxiliary screeds 34 may be located immediately adjacent main screed 32, in front of main screed 32, or behind main screed 32 relative to a normal forward traveling direction of paving machine 10. Screed assembly 16 may also include one or more screed extensions 45 that are connectable to auxiliary screeds 34 to increase the width of the resulting asphalt layer 38.

Each of main and auxiliary screeds 32, 34 may include a frame 40, 42, respectively. Frames 40, 42 may be operatively connected to machine frame 20 via tow arms 28. Main and auxiliary screeds 32, 34 may each include one or more screed plates 44. Frame 40 of main screed 32 may be connected directly or indirectly to machine frame 20. For example, frame 40 may be bolted or welded to tow arms 28, and tow arms 28 may in turn be connected to machine frame 20 referring to FIG. 1) by way of actuators 30. When tow arms 28 are connected to machine frame 20 via actuators 30, the operator of paving machine 10 may be able to raise, lower, shift, and/or tilt frame 40 to adjust a location and/or operation of main screed 32. Frame 42 of auxiliary screeds 34 may be connected to frame 40 of main screed 32 and/or to machine frame 20 (e.g., via tow arms 28) via hydraulic actuators 36. Screed extensions 45 may be mechanically connected to auxiliary screeds 34, for example, via bolts or other fasteners, and may also include a screed plates 44.

Figure 3:
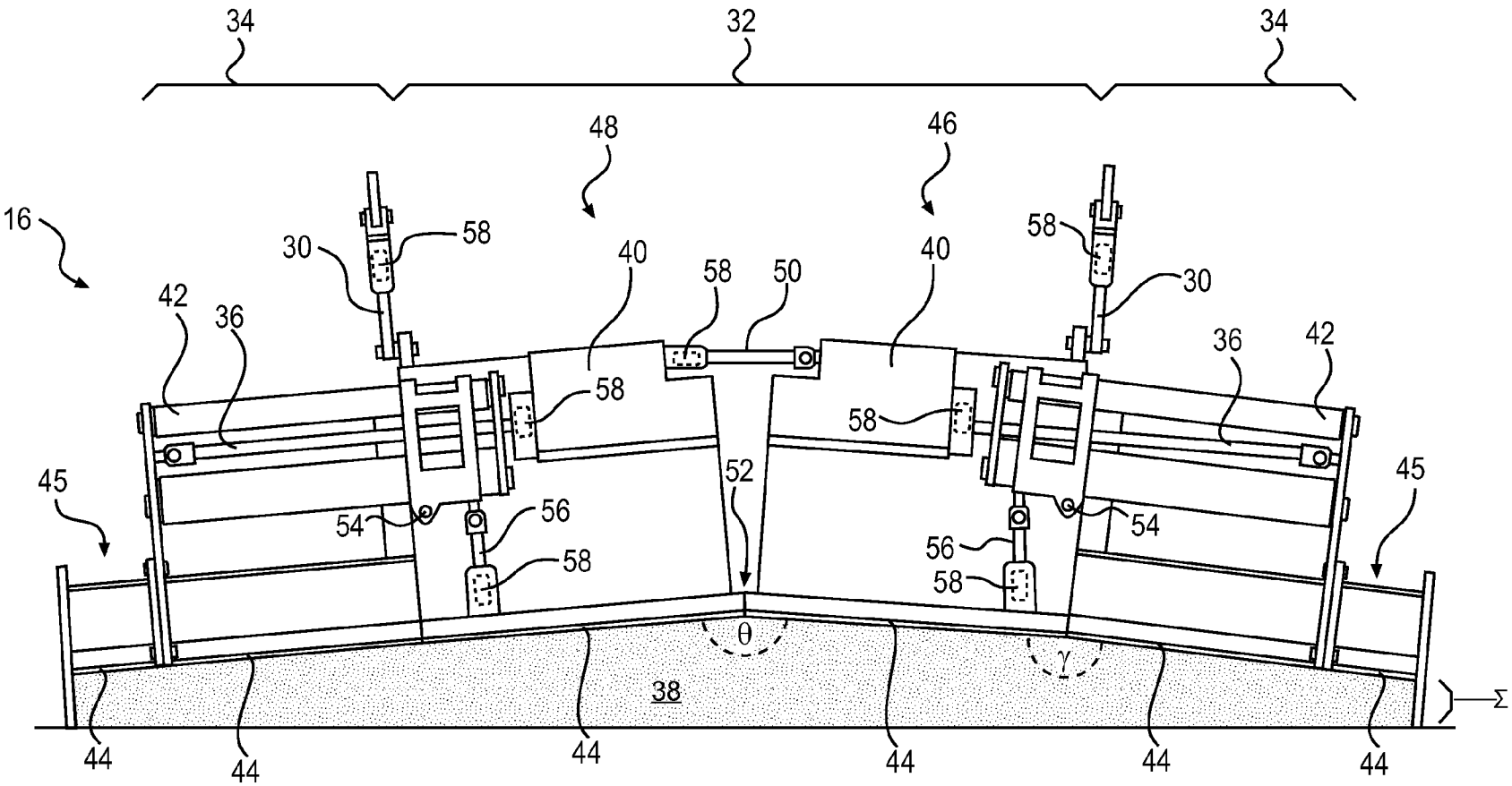

As shown in FIG. 3, main screed 32 may include a right side 46 and a left side 48 that are connected by an actuator 50. Left and right sides 46, 48 of main screed 32 may also be pivotally connected at a pivot point 52. Actuator 50 may be adjusted to rotate left and right sides 46, 48 about pivot point 52 to change a position of screed plates 44 and adjust a crown of asphalt layer 38. For example, as actuator 50 is extended, left and right sides 46, 48 may rotate about pivot point 52, thereby decreasing an angle $\theta$ between screed plates 44 of main screed 32. The angle $\theta$ may be decreased from an initial angle (e.g., 180°) at which screed plates 44 of right and left sides 46, 48 are coplanar. By their connection to main screed 32, auxiliary screeds 34 and screed extensions 45 may also be tilted when actuator 50 is extended, thereby changing the position of screed plates 44 of auxiliary screeds 34 and screed extensions 45. In other embodiments, the angle $\theta$ may be increased from the initial angle, if desired.

Auxiliary screeds 34 may be pivotally connected to main screed 32 to allow a grade or slope of asphalt layer 38 to be controlled. For example, frame 42 of auxiliary screed 34 may be connected to main screed 32 via a pivot point 54 that allows screed plate 44 of auxiliary screed 34 to be tilted with respect to screed plate 44 of main screed 32. Frame 42 of auxiliary screed 34 may also be connected to main screed 32 by an actuator 56 that is configured to rotate frame 42 of auxiliary screed 34 about pivot point 54. For example, as actuator 56 extends, frame 42 may rotate about pivot point 54, thereby tilting auxiliary screed 34 and decreasing an angle $\gamma$ between screed plate 44 of auxiliary screed 34 and screed plate 44 of main screed 32. The angle $\gamma$ may be decreased from an initial angle (e.g., 180°) at which screed plates 44 of main screed 32 and auxiliary screed 34 are coplanar. By its connection to auxiliary screed 34, screed extensions 45 may also be tilted as auxiliary screed 34 is rotated about pivot point 54 via actuator 56. In other embodiments, the angle $\gamma$ may be increased from the initial angle, if desired.

In some embodiments, actuators 30, 36, 50, and 56 may each be associated with a sensor 58 that is configured to generate a signal indicative of a position of a respective one of actuators 30, 36, 50, 56. For example, sensors 58 may be position sensors disposed within each of actuators 30, 36, 50, 56. Sensors 58 may be configured to generate a signal indicative of a position of a first end of a respective actuator with respect to a second end of the respective actuator. In other words, sensors 58 may be configured to generate a signal indicative of a length of actuators 30, 36, 50, 56.

Figure 4:
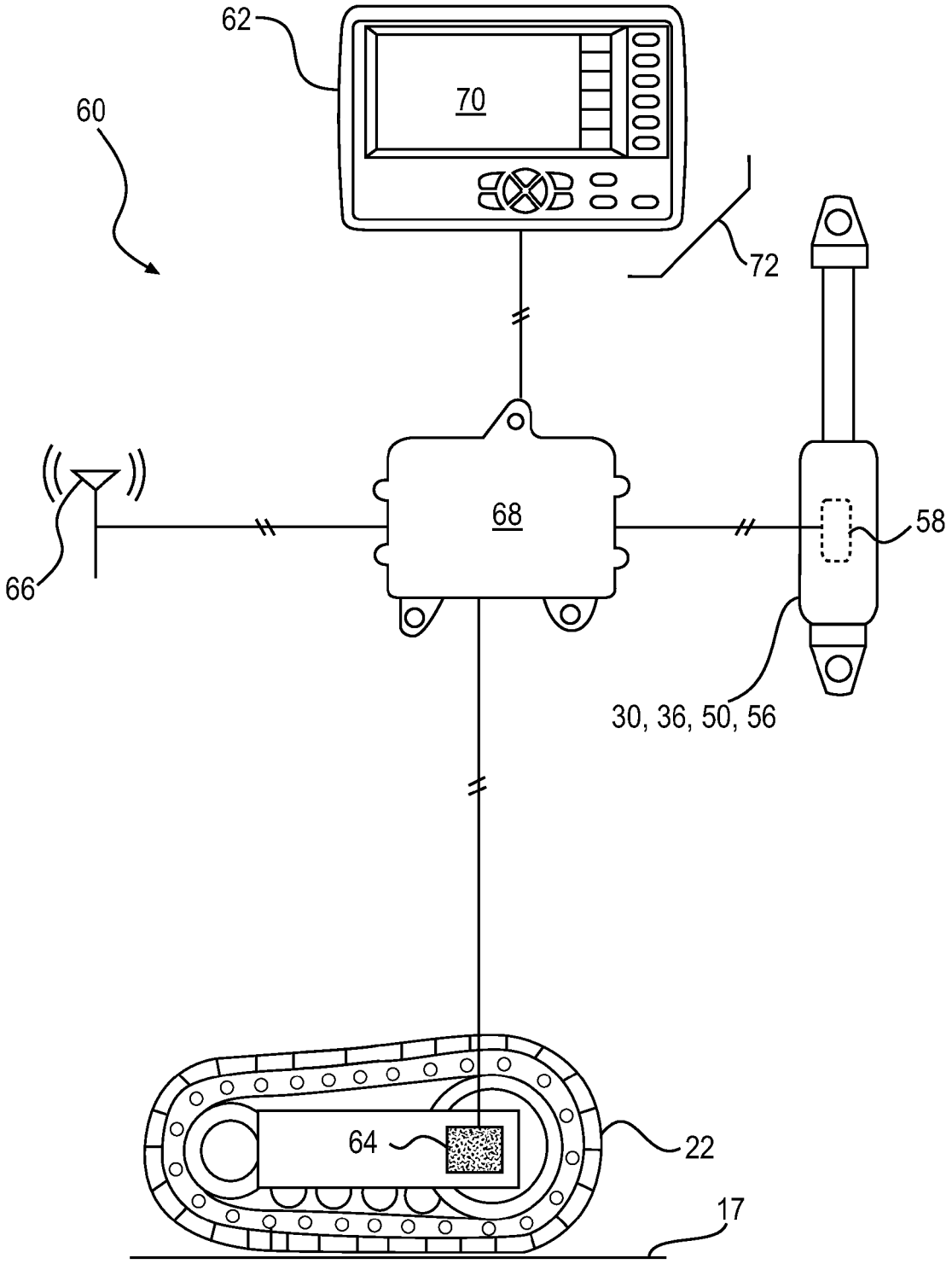
FIG. 4 is a diagrammatic illustration of an exemplary disclosed production monitoring system that may be used in conjunction with the paving machine of FIG. 1.

As shown in FIG. 4, a production monitoring system 60 ("monitoring system") may be associated with paving machine 10 (referring to FIG. 1) and include elements that cooperate to determine and track an amount of paving material deposited by paving machine 10 onto work surface 17 (referring to FIG. 1). Elements of monitoring system 60 may include sensors 58, an interface device 62, a speed sensor 64, a communication device 66, and a controller 68 electronically connected to each of the other components. Using information from sensors 58 and interface device 62, controller 68 may be configured to determine a thickness profile Σ of asphalt layer 38 (referring to FIGS. 2-3). Based on the thickness profile Σ of asphalt layer 38 and information from interface device 62, speed sensor 64, and/or communication device 66, controller 68 may be configured to determine an amount of material deposited onto work surface 17.

In the disclosed example, interface device 62 may include, among other things, a display 70 and an input device 72. Interface device 62 may be located in operator station 26 (referring to FIG. 1) or at another location on paving machine 10. In other embodiments, interface device 62 may be offboard paving machine 10. For example, interface device 62 may embody a remote control, such as a handheld controller, that an operator may use to control paving machine 10 from anywhere on the worksite. Interface device 62 may alternatively embody a software program and user interface for a computer, and may include a combination of hardware and software. In other embodiments, paving machine 10 may be autonomous and may not include interface device 62.

Display 70 may be configured to render the location of paving machine 10 relative to features of work surface 17 (e.g., paved and/or unpaved parts of work surface 17), and to display data and/or other information to the operator. Input device 72 may be configured to receive one or more inputs, data, and/or instructions from the operator of paving machine 10. For example, input device 72 may be an analog input device that receives control instructions via one or more buttons, switches, dials, levers, etc. Input device 72 may also or alternatively include digital components, such as one or more soft keys, touch screens, and/or visual displays. Other interface devices (e.g., control devices) may also be possible, and one or more of the interface devices described above could be combined into a single interface device, if desired.

Speed sensor 64 may be associated with one or more traction devices 22, and may be configured to generate a signal indicative of a groundspeed of paving machine 10. For example, speed sensor 64 may be a magnetic pickup-type sensor in communication with a magnet embedded within a rotational component of traction device 22. Speed sensor 64 may alternatively be associated with a different component of paving machine 10 (e.g., a driveshaft, a transmission, flywheel, etc.), or embody a different type of sensor. In other embodiments, speed sensor 64 may be a GPS device, Doppler device, or other type of position detecting device capable of generating a signal indicative of the ground speed and/or a distance traveled by paving machine 10.

Communication device 66 may include hardware and/or software that enables sending and receiving of data messages between controller 68 and an offboard entity (e.g., a haul truck, a back office computer, a computer network, a paving material plant, etc.). The data messages may be sent and received via a direct data link and/or a wireless communication link, as desired. The direct data link may include an Ethernet connection, a connected area network (CAN), or another data link known in the art. The wireless communications may include satellite, cellular, infrared, WiFi, Bluetooth, and/or any other type of wireless communications that enables communication device 66 to exchange information between paving machine 10 and the offboard entity.

Controller 68 may embody a single microprocessor or multiple microprocessors that include a means for monitoring operator and sensory inputs, and determining the amount of paving material deposited onto work surface 17 by paving machine 10 based on the inputs. For example, controller 68 may include a memory, a secondary storage device, a clock, and a processor, such as a central processing unit or any other means for accomplishing a task consistent with the present disclosure. Numerous commercially available microprocessors can be configured to perform the functions of controller 68. It should be appreciated that controller 68 could readily embody a general machine controller capable of controlling numerous other machine functions. Various other known circuits may be associated with controller 68, including signal-conditioning circuitry, communication circuitry, and other appropriate circuitry. Controller 68 may be further communicatively coupled with an external computer system, instead of or in addition to including a computer system, as desired.

Controller 68 may be configured to determine a calculated amount of material $M_1$ deposited by paving machine 10 onto work surface 17 based on one or more signals from input device 72 and/or communication device 66. For example, controller 68 may be configured to receive a first signal from the operator of paving machine 10 via input device 72 indicative of a reference height h of screed assembly 16 above work surface 17. The reference height h may be a vertical distance between work surface 17 and pivot point 52 (referring to FIG. 3) of main screed 32 and may represent a desired thickness of asphalt layer 38.

Controller 68 may also be configured to determine a thickness profile Σ of asphalt layer 38 based on the reference height h and a total width w of screed assembly 16. The thickness profile Σ of asphalt layer 38 may be the thickness of asphalt layer 38 (i.e., the distance between work surface 17 and screed plates 44—referring to FIG. 3) across the total width w of screed assembly 16. In other words, the thickness profile Σ may be the area of a cross section of asphalt layer 38 between work surface 17 and screed plates 44 along the total width w of screed assembly.

In one example, controller 68 may determine the total width w of screed assembly 16 based on known dimensions of screed assembly 16 stored within its memory (e.g., known dimensions of main screed 32, auxiliary screeds 34, and screed extensions 45). In another example, controller 68 may be configured to determine the total width w of screed assembly 16 based on an input from the operator of paving machine 10 via input device 72. When screed assembly 16 includes sensors 58, controller 68 may be configured to determine the total width w of screed assembly 16 based on signals received from sensors 58 in conjunction with known dimensions stored within its memory and/or dimensions received as inputs from the operator via input device 72.

Controller 68 may determine the thickness profile Σ by, for example, multiplying the total width w of screed assembly 16 by the reference height h. In some situations, the reference height h may be equal to or an approximation of the desired thickness of asphalt layer 38 across the total width w of screed assembly 16. In other situations, however, the height of screed plates 44 above work surface 17 may vary during the paving operation, and the total width w of screed assembly 16 may be varied in accordance with job constraints. Thus, when screed assembly 16 includes sensors 58, controller 68 may determine the thickness profile Σ based on the signals from sensors 58 in conjunction with one or more geometric calculations using known dimensions of screed assembly 16 stored within its memory and/or received from the operator via input device 72. In this way, the thickness profile Σ may be determined based on a current position of screed plates 44.

Controller 68 may determine the calculated amount of material $M_1$ (e.g., a volume, a weight, etc.) deposited onto work surface 17 by paving machine 10 based on the thickness profile Σ and a ground speed s of paving machine 10. For example, controller 68 may determine the ground speed s of paving machine 10 based on the signal generated by speed sensor 64. By multiplying the ground speed s of paving machine 10 by the thickness profile Σ, controller 68 may be configured to determine an instantaneous volumetric rate of material deposition $\dot{V}$ onto work surface 17. Controller 68 may continually determine the instantaneous volumetric rate of material deposition $\dot{V}$ and multiply it by an amount of paving time to determine a volume V of material deposited onto work surface 17. By summing the volume V of deposited material over a period of paving time (e.g., a shift, a day, for time spent on a particular jobsite, etc.), controller 68 may be configured to determine a total volume $V_{total}$ of deposited material. Controller 68 may be configured to show the instantaneous volumetric rate of material deposition $\dot{V}$ (e.g., cubic meters/hour, cubic yards/hour, etc.) and/or the total volume $V_{total}$ (e.g., cubic meters, cubic yards, etc.) of deposited material to the operator of paving machine 10 via display 70.

Controller 68 may also be configured receive a second signal (e.g., via input device 72 or communication device 66) indicative of a density ρ of the material delivered to paving machine 10. The material delivered to paving machine 10 may be the same type of material deposited onto work surface 17. Thus, the density ρ of the material delivered to paving machine 10 may be equal to the density ρ of the material deposited onto work surface 17. Controller 68 may be configured to multiply the density ρ of the material delivered to paving machine 10 by the instantaneous volumetric rate of material deposition $\dot{V}$ and/or the total volume $V_{total}$ of deposited material to determine an instantaneous rate of material deposition by weight $\dot{W}$ and/or a total weight $W_{total}$ of deposited material, respectively. Controller 68 may be configured to show the instantaneous rate of material deposition by weight $\dot{W}$ (e.g., tonnes/hour) and/or the total weight $W_{total}$ (e.g., tonnes) of deposited material to the operator of paving machine 10 via display 70.

The amount of material $M_1$ deposited by paving machine 10 may be equal to the total weight $W_{total}$ of deposited material, the total volume $V_{total}$, or another amount of material deposited onto work surface 17, as desired. $M_1$ may represent an amount of material consumed during the paving process that may be comparable to a known amount of material delivered to paving machine 10. For example, when an amount of material $M_2$ delivered to paving machine 10 is provided as a weight value (e.g., in tonnes), $M_1$ may be equal to the total weight $W_{total}$ of deposited material. When the amount of material $M_2$ delivered to paving machine 10 is provided as a volumetric value (e.g., in cubic meters, cubic yards, etc.), $M_1$ may be equal to the total volume $V_{total}$ of deposited material. It is understood that $M_1$ may represent a different amount of material or have a different unit of measurement, if desired.

Controller 68 may also be configured to receive a third signal (e.g., via input device 72 or communication device 66) indicative of the amount of material $M_2$ delivered to paving machine 10, and compare the amount of delivered material $M_2$ to the calculated amount of material $M_1$ deposited by paving machine 10 onto work surface 17. For example, the third signal may be indicative of a weight (e.g., a tonnage), a volume (e.g., a cubic yardage), or another unit of material that has been delivered to paving machine 10 and/or loaded into hopper 14. Controller 68 may receive the third signal each time material is delivered to paving machine 10. Controller 68 may be configured to compare the delivered amount of material $M_2$ to the calculated amount of material $M_1$ deposited onto work surface 17 in order to determine a correction factor Δ. For example, the correction factor Δ may be determined according to EQ1 below. Other ways of determining the correction factor Δ may be possible.

$$\Delta = M_2/M_1 \qquad \text{EQ1:}$$

The correction factor Δ may be indicative of a difference between the calculated amount of material $M_1$ deposited by paving machine 10 and the amount of material $M_2$ delivered to paving machine 10. The difference between $M_1$ and $M_2$ may be attributed to one or more production factors, depending on the circumstances. For example, approximations of the reference height h, total width w, angles θ and γ, material buildup in hopper 14 or conveying system 18, and other known and/or unknown factors may contribute to the difference.

When the full amount of material $M_2$ delivered to paving machine 10 is deposited onto work surface 17, the amount of material $M_2$ delivered to paving machine 10 may be equal to an actual amount of material deposited onto work surface 17. Accordingly, controller 68 may be configured to determine the correction factor Δ each time the full amount of material delivered $M_2$ to paving machine 10 is deposited onto work surface 17. Controller 68 may be configured to multiply the correction factor Δ by future determinations of $\dot{V}$, $\dot{W}$, $V_{total}$ and/or $W_{total}$ in order to account for the difference between $M_1$ and $M_2$ and achieve more accurate determinations of the calculated amount of material $M_1$ deposited by paving machine 10.

INDUSTRIAL APPLICABILITY

The disclosed production monitoring system may be applicable to any paving machine where tracking the instantaneous and/or total amount of deposited material is important. The production monitoring system may allow for more accurate determinations of the instantaneous and/or total amount of deposited material, and may provide for automatic communication of paving material information between the paving machine and offboard entities. The production monitoring system may also monitor the position of screed assembly components in order to improve the accuracy of the calculated instantaneous and/or total amount of deposited material. Operation of production monitoring system 60 will now be explained.

Production monitoring system 60 may help operators track paving production at one or more jobsites. Thus, at the beginning of a paving operation, the operator of paving machine 10 may select a saved profile associated with the current jobsite or create a new jobsite profile via interface device 62. The operator may select or create a jobsite identifier (e.g., a name, a number, etc.), and any machine settings or production statistics may be tracked and associated with the jobsite identifier. For example, monitoring system 60 may keep track of production data for each "pull" or each time paving machine 10 is set up to pave a portion of work surface 17, and store the data in association with the jobsite identifier for future reference.

Before each pull, the operator may set up screed assembly 16 to ensure asphalt layer 38 achieves desired characteristics (e.g., thickness, width, crown, slope, etc.) based on a jobsite plan and/or customer specifications. Setting up screed assembly 16 may include setting the reference height h of screed assembly 16, for example, by raising screed assembly 16 via actuators 30 and resting screed plates 44 on reference objects (e.g., blocks of wood) that match the desired thickness of asphalt layer 38. The operator may enter the reference height h into input device 72 while screed plates 44 are resting on the reference objects by, for example, pressing a button or soft key associated with input device 72.

Setting up screed assembly may further include adjusting the total width w and orientation of screed assembly 16. For example, the operator may adjust the angle θ or crown of main screed 32 via actuator 50, the width of auxiliary screeds 34 via actuators 36, and the angle γ of auxiliary screeds 34 via actuators 56. The operator may also attach screed extensions 45 to auxiliary screeds at this time, if desired. Once all components of screed assembly 16 are set up as desired, the total width w of screed assembly 16 may be determined and entered via input device 72.

When paving machine includes sensors 58, controller 68 may automatically determine the total width w based on signals from sensors 58 and known dimensions of screed assembly 16. At this time, the operator may also reset or "zero" each sensor 58, thereby creating reference values for each sensor 58, by pressing a button or soft key associated with input device 72. In this way, the movements of each actuator during the paving operation may be observed by controller 68 with respect to a neutral position and used to more accurately determine the thickness profile Σ of asphalt layer 38 during the paving operation.

Controller 68 may also receive an input of paving material information before each pull. In one embodiment, paving material information, such as the density ρ and the amount of material $M_2$ delivered to paving machine 10, may be entered manually by the operator of paving machine 10. For example, the operator may enter the density ρ associated with the paving material and the amount of material $M_2$ (e.g., measured in tonnes, cubic meters, etc.) delivered by a particular truck via input device 72. In another embodiment, paving material information may be automatically received by controller 68 via communication device 66. For example, as a haul truck approaches paving machine 10 to deliver paving material, communication device 66 may automatically receive signals indicative of the density ρ, the amount $M_2$, and/or other information associated with the delivered paving material and communicate the signals to controller 68.

When the pull is started, the operator may indicate that screed assembly 16 is in a paving or "float" mode by, for example, pressing a button or soft key associated with input device 72. Controller 68 may track a paving time when the float mode is selected and store the paving time in its memory for future reference. When in float mode, paving machine 10 may be propelled in a forward direction by traction devices 22, and paving material may be deposited in front of screed assembly 16 by conveying system 18. At this time, controller 68 may start to continually determine the thickness profile Σ of asphalt layer 38.

In one embodiment, controller 68 may determine the thickness profile Σ to be uniform and constant during the paving operation based on the reference height h and the total width w of screed assembly 16. In another embodiment, controller 68 may determine the thickness profile Σ by determining a height, length, and/or angle of each screed plate 44 based on the reference height h, the readings from sensors 58, and known dimensions of screed assembly 16. Controller 68 may also or alternatively determine the angles θ and γ based on the signals from sensors 58.

When paving machine includes sensors 58, the signals generated by sensors 58 may be indicative of changes in the position of screed plates 44 that occur throughout the paving process. For example, as paving machine 10 traverses work surface 17, screed assembly 16 may rise and fall due to contours in work surface 17, which may result in a change in the thickness profile Σ of asphalt layer 38. Additionally, the total width w of screed assembly may be changed by the operator (e.g., via actuators 36, 50, and 56) during the paving process depending on the paving plan and/or customer's specifications. Sensors 58 may automatically detect these changes and communicate them to controller 68 via their generated signals. Thus, each thickness profile Σ determination made by controller 68 may be based on current positions of screed plates 44 with respect to the reference values previously set by the operator. In this way, controller 68 may more accurately determine the thickness profile Σ of asphalt layer 38 throughout the paving operation.

Controller 68 may then continually determine the amount of material $M_1$ being deposited by paving machine 10 based on the thickness profile Σ. For example, controller 68 may determine the volumetric rate of material deposition $\dot{V}$ and total volume $V_{total}$ based on the thickness profile Σ and the ground speed s of paving machine 10 over the period of paving time. Controller 68 may also multiply the volumetric rate of material deposition $\dot{V}$ and total volume $V_{total}$ by the density ρ to determine the rate of material deposition by weight $\dot{W}$ and the total weight $W_{total}$ of material deposited by paving machine 10 over the same period of paving time. Controller 68 may show one or more of $\dot{V}$, $\dot{W}$, $V_{total}$ and/or $W_{total}$ to the operator via display 70. Controller 68 may then set the calculated amount of material $M_1$ deposited by paving machine 10 equal to the total volume $V_{total}$ or the total weight $W_{total}$, as desired.

After the full amount of material $M_2$ delivered to paving machine 10 has been moved from hopper 14 by conveying system 18 and deposited onto work surface 17 under screed assembly 16, controller 68 may then determine the correction factor Δ based on the amount of material $M_2$ delivered and the calculated amount of material $M_1$ deposited by paving machine 10. For example, when the operator of paving machine 10 determines that the full amount $M_2$ of material delivered to paving machine 10 has been deposited onto work surface 17, the operator may press a button or soft key associated with input device 72 causing controller 68 to calculate the correction factor Δ. Controller 68 may then show the correction factor Δ to the operator via display 70.

To refill hopper 14, a subsequent amount $M_2$ of material may then be delivered to paving machine 10 via a haul truck or other source. The subsequent amount $M_2$ and corresponding density ρ of the delivered material may be manually entered by the operator (e.g., via input device 72) or automatically received via communication device 66. In this way, the correction factor Δ may be determined each time paving machine 10 receives more material.

In some situations, however, deliveries may be made to paving machine 10 that are not immediately entered into controller 68 either manually or automatically. In these situations, the operator may subsequently enter each previous delivery at a convenient time via input device 72, and controller 68 may update the correction factor Δ at that time based on the delivered amounts and the calculated total volume $V_{total}$ and/or total weight $W_{total}$ since the last logged delivery. Alternatively, the operator may enter a total amount of material delivered during a number of deliveries as well as a number trucks used to deliver the material, and controller 68 may determine an average delivery amount before updating the correction factor Δ.

After hopper 14 is refilled with a subsequent amount $M_2$ of material delivered to paving machine 10 and a subsequent pull is initiated, controller 68 may multiply subsequent determinations of $\dot{V}$, $\dot{W}$, $V_{total}$ and/or $W_{total}$ by the correction factor Δ before showing them to the operator via display 70. In this way, the determinations of $\dot{V}$, $\dot{W}$, $V_{total}$ and/or $W_{total}$ may be more accurate as the paving process continues, allowing operators to quickly identify and adjust paving parameters that are outside desired specifications based on the corrected determinations. By showing operators the correction factor Δ, operators may also be able to determine how accurate the calculated determinations are over a given amount of paving time.

Several advantages may be associated with the disclosed production monitoring system. For example, because controller 68 may receive and store paving material information, statistical tabulations and calculations may be performed automatically by controller 68, allowing operators to focus on other aspects of the paving operation. Also, because information regarding material delivered to paving machine 10 may be received automatically via communication device 66, operators may not be required to enter delivery information and may be allowed to focus on other aspects of the paving operation. Because controller 68 may determine the correction factor Δ based on material delivery information received and material information calculated during the paving process, subsequent calculations of the rate and amount of material deposited onto work surface 17 may be more accurate, allowing operators to more accurately identify when and how to adjust paving parameters to satisfy customer specifications.

It will be apparent to those skilled in the art that various modifications and variations can be made to the disclosed production monitoring system. Other embodiments will be apparent to those skilled in the art from consideration of the specification and practice of the disclosed production monitoring system. It is intended that the specification and examples be considered as exemplary only, with a true scope being indicated by the following claims and their equivalents.

What is claimed is:

1. A monitoring system for a paving machine having a screed, the monitoring system comprising:

an input device configured to receive a first input from an operator of the paving machine, the first input being indicative of a height of the screed above a work surface; and a controller electronically connected to the input device and configured to:

determine an amount of a material deposited by the paving machine based at least in part on the first input;

receive a signal indicative of an amount of a material delivered to the paving machine;

determine a correction factor as a ratio of the amount of the material delivered to the paving machine to the amount of the material deposited by the paving machine; and determine a second amount of material deposited by the paving machine based at least on the correction factor and the first input.

2. The monitoring system of claim 1, wherein the controller is configured to determine the amount of material deposited by the paving machine based on the first input, a width of the screed, and a speed of the paving machine.

3. The monitoring system of claim 1, wherein the controller is further configured to determine a rate of material deposition based on the correction factor.

4. The monitoring system of claim 3, further including a display in electronic communication with the controller, wherein the controller is configured to show one or more of the amount of material deposited, the rate of material deposition, and the correction factor to an operator of the paving machine via the display.

5. The monitoring system of claim 4, wherein the controller is further configured to:

receive a signal indicative of a density of the material delivered to the paving machine; and determine the amount of the material deposited by the paving machine based on the density of the material delivered to the paving machine.

6. The monitoring system of claim 5, wherein the input device is configured to:

receive a second input indicative of the density of the material delivered to the paving machine;

receive a third input indicative of the amount of the material delivered to the paving machine; and generate the signals indicative of the density and the amount of the material delivered to the paving machine based on the second and third inputs.

7. The monitoring system of claim 5, further including a communication device electronically connected to the controller and configured to:

automatically receive the signals indicative of the amount and the density of the material delivered to the paving machine from offboard the paving machine; and communicate the signals to the controller.

8. The monitoring system of claim 4, wherein the screed includes:

one or more plates configured to shape a layer of paving material;

one or more actuators configured to adjust a position of the one or more plates; and one or more sensors associated with each of the one or more actuators and configured to generate a signal indicative the position of the one or more plates.

9. The monitoring system of claim 8, wherein the controller is configured to determine a thickness profile of the layer of paving material based on the signal generated by the one or more sensors.

10. The monitoring system of claim 9, wherein the controller is configured to determine the amount of the material deposited by the paving machine based on the thickness profile of the layer of paving material.

11. A method of monitoring a paving machine having a screed, the method comprising:

receiving a first input from an operator of the paving machine, the first input being indicative of a height of the screed above a work surface;

determining an amount of a material deposited by the paving machine based at least on the first input, a width of the screed, and a speed of the paving machine;

receiving a signal indicative of an amount of a material delivered to the paving machine;

determining a correction factor as a ratio of the amount of the material delivered to the paving machine to the amount of the material deposited by the paving machine; and determining a second amount of material deposited by the paving machine based at least on the correction factor and the first input.

12. The method of claim 11, further including determining a rate of material deposition based on the correction factor.

13. The method of claim 12, further including showing one or more of the amount of material deposited, the rate of material deposition, and the correction factor to an operator of the paving machine.

14. The method of claim 13, further including:

receiving a signal indicative of a density of the material delivered to the paving machine; and determining the amount of the material deposited by the paving machine based on the density of the material delivered to the paving machine.

15. The method of claim 14, further including:

receiving a second input from the operator of the paving machine, the second input being indicative of the density of the material delivered to the paving machine;

receiving a third input from the operator of the paving machine, the third input being indicative of the amount of the material delivered to the paving machine; and generating the signals indicative of the density and the amount of the material delivered to the paving machine based on the second and third inputs.

16. The method of claim 14, further including automatically receiving the signals indicative of the amount and the density of the material delivered to the paving machine from offboard the paving machine.

17. The method of claim 13, wherein:

the screed includes one or more sensors associated with one or more actuators connected to one or more plates that are configured to shape a layer of paving material; and the method further includes receiving a signal indicative of a position of the one or more plates from the one or more sensors.

18. The method of claim 17, further including:

determining a thickness profile of the layer of paving material based on the signal from the one or more sensors; and determining the amount of the material deposited by the paving machine based on the thickness profile of the layer of paving material.

19. A paving machine comprising:

a machine frame;

a plurality of traction devices configured to support the machine frame;

an engine mounted to the machine frame and configured to drive the plurality of traction devices;

a hopper mounted at a first end of the machine frame;

a conveying system configured to transport material from the hopper to a second end of the machine frame; and a screed mounted at the second end of the machine frame;

an input device configured to receive an input from an operator of the paving machine, the input being indicative of a height of the screed above a work surface; and a controller electronically connected to the input device and configured to:

determine an amount of a material deposited by the paving machine based at least in part on the input;

receive a signal indicative of an amount of a material delivered to the paving machine;

determine a correction factor as a ratio of the amount of the material delivered to the paving machine to the amount of the material deposited by the paving machine; and determine a second amount of material deposited by the paving machine based at least on the correction factor and the input.

20. The paving machine of claim 19, wherein the controller is configured to determine the amount of material deposited by the paving machine based on the first input, a width of the screed, and a speed of the paving machine.

* * * * *